United States Patent [19]

Ryan, Jr.

[11] 4,197,480

[45] Apr. 8, 1980

[54] REFLECTOR-TYPE HID SODIUM VAPOR LAMP UNIT WITH DICHROIC REFLECTOR

[75] Inventor: William T. Ryan, Jr., Chatham Township, Morris County, N.J.

[73] Assignee: Westinghouse Electric Corp., Pittsburgh, Pa.

[21] Appl. No.: 941,900

[22] Filed: Sep. 11, 1978

[51] Int. Cl.[2] ..... H01J 61/22; H01J 61/30; H01J 61/40

[52] U.S. Cl. ..... 313/25; 313/113; 313/227

[58] Field of Search ..... 313/113, 184, 25, 112, 313/229, 227

[56] References Cited

U.S. PATENT DOCUMENTS

| | | | |
|---|---|---|---|
| 2,830,210 | 4/1958 | Jenne, Jr. et al. | 313/184 X |
| 2,945,146 | 7/1960 | Meyer | 313/184 X |
| 3,174,067 | 3/1965 | Bahrs | 313/113 X |
| 3,288,989 | 11/1966 | Cooper | 313/113 X |
| 3,341,731 | 9/1967 | Wilson | 313/113 |
| 3,527,974 | 9/1970 | Cooper | 313/113 |
| 3,781,586 | 12/1973 | Johnson | 313/229 X |
| 3,931,536 | 1/1976 | Fohl et al. | 313/113 |
| 3,974,410 | 8/1976 | Collins et al. | 313/229 X |
| 4,053,809 | 10/1977 | Fridrich et al. | 313/113 X |
| 4,109,175 | 8/1978 | Watarai et al. | 313/113 X |

OTHER PUBLICATIONS

Bausch & Lomb Publication Entitled, "Bausch & Lomb Multi-films," particularly p.23 entitled Heat Control Filters, also contains graphs of transmittance vs wave-lengths, on an additional page not numbered, for several types of filters.

*Primary Examiner*—Palmer C. Demeo

*Attorney, Agent, or Firm*—R. S. Lombard

[57] ABSTRACT

A reflector-type high-intensity-discharge vapor lamp unit having a generally parabolic rear reflector member is provided with a dichroic reflector carried as a coating on the inner surface thereof. The dichroic reflector selectively reflects visible light having a wave-length from about 400 to 750 nanometers and selectively transmits infrared radiation having a wavelength from about 750 to 1600 nanometers.

3 Claims, 2 Drawing Figures

REFLECTOR-TYPE HID SODIUM VAPOR LAMP UNIT WITH DICHROIC REFLECTOR

BACKGROUND OF THE INVENTION

This invention relates to reflector-type lamps and, more particularly, to reflector-type high-intensity-discharge lamps which incorporate a particular dichroic coating.

Incandescent lamps utilizing a reflector incorporated as a coating on the interior surface of the lamp envelope is well known. The reflective coating is typically composed of aluminum.

Dichroic reflective coatings may be used when it is desirable to reflect infrared radiation and transmit visible light or vice versa. One application using a dichroic reflector of the former type in a high-pressure sodium vapor lamp is disclosed in U.S. Pat. No. 3,931,536, issued to Timothy Fohl et at., dated Jan. 6, 1976. The Fohl patent discloses the use of a reflective filter carried as a coating on the lamp envelope that selectively reflects arc discharge radiation in the infrared region of the electromagnetic spectrum to which the arc tube walls are transparent and to which the arc plasma is optically thick, so that the reflected infrared radiation is preferentially absorbed by the arc plasma to improve lamp efficiency. A second application utilizing the latter type of dichroic reflector i.e., one that reflects visible light and transmits infrared radiation, is in conjunction with incandescent lamps having special applications, such as illuminating frozen food and produce showcases where the introduction of heat is undesirable or for use in store windows to reduce fading of merchandise.

SUMMARY OF THE INVENTION

There is provided a reflector-type high-intensity-discharge (HID) lamp unit of particular use as a lighting unit for special applications, such as in coal mines where any exposed surface of the lighting unit is required to remain below a preset maximum operating temperature. The lamp unit comprises an elongated arc tube enclosing a discharge sustaining filling and having electrodes operatively disposed proximate the ends thereof. The arc tube is supported within an outer protective envelope having a front cover member for permitting the passage of visible light therethrough and a generally parabolic rear reflector member.

Electrical lead-in members are sealed through the arc tube and connected to the electrodes. An electrical adapter means is affixed to the reflector member to facilitate connection of the arc tube to a source of electrical power. The rear reflector member has a dichroic reflector means carried as a coating on the inner surface thereof. The dichroic reflector means selectively reflects visible light having a wavelength from about 400 to 750 nanometers (nm) and selectively transmits infrared radiation having a wavelength from about 750 through 1600 nm, thereby permitting the exposed external surface of the lighting unit to remain below the predetermined safe operating temperature. In addition, the light output is improved over that obtained with an otherwise similar lamp which utilizes an aluminum reflector.

BRIEF DESCRIPTION OF THE DRAWING

For a better understanding of the invention, reference may be had to the accompanying drawings in which.

DESCRIPTION OF THE PREFERRED EMBODIMENT

Figure 1:
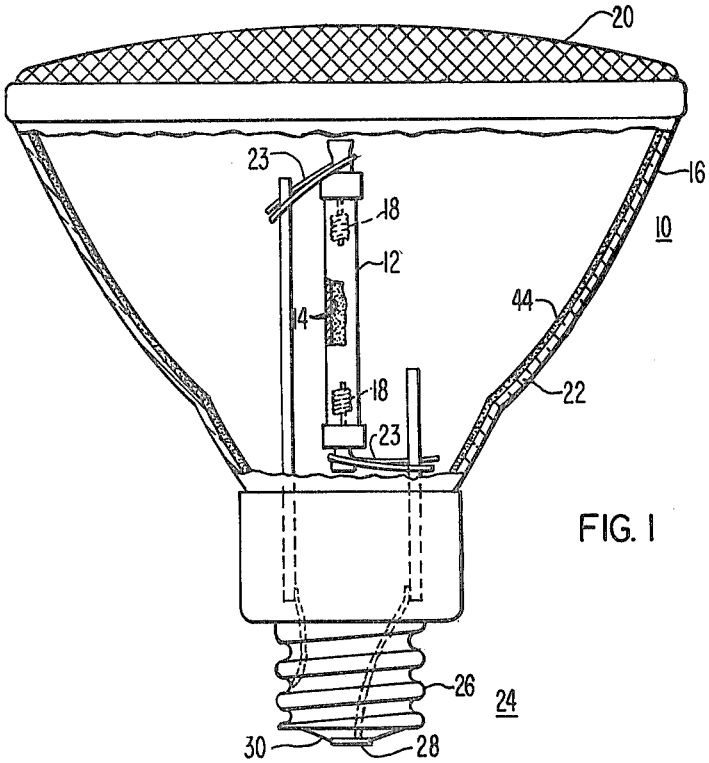
FIG. 1 is in elevational view, partly in section, of an HID sodium lamp unit showing the location of the dichroic coating within the lamp unit.

In FIG. 1 is shown an HID reflector-type lamp unit 10 comprising an elongated arc tube 12 formed of alumina and enclosing a discharge-sustaining filling comprising sodium 14 or sodium plus mercury. The arc tube 12 is supported within an outer protective envelope 16. The arc tube 12 has electrodes 18 operatively disposed proximate the ends thereof. The electrodes 18 are typically made of tungsten with an emissive material such as dibarium calcium tungstate adhered thereto. The envelope 16 has a front cover member or lens 20 for permitting the passage of light therethrough and a rear reflector member 22. The reflector member 20 has a generally parabolic configuration with the light source centered at approximately the focal point of the reflector. Because of the elongated light source, there will be some spreading of the beam. The configuration of the reflector 20 can be altered somewhat from parabolic to a greater spread for the beam, to achieve a flood pattern. This can also be accomplished by a light-spreading lens, if desired. Preferably, the arc tube 12 is axially aligned with respect to the parabolic reflector 22. Electrical lead-in members 23 are sealed through the arc tube 12 and are connected to the electrodes 18. Electrical adaptor means 24 is typically made of a thin cylindrical metallic shell 26 and a metallic center eyelet 28 insulated from the shell 26 by insulator member 30. The electrical adaptor means 24 facilitates the connection of the arc tube 12 to a source of electrical power.

Figure 2:
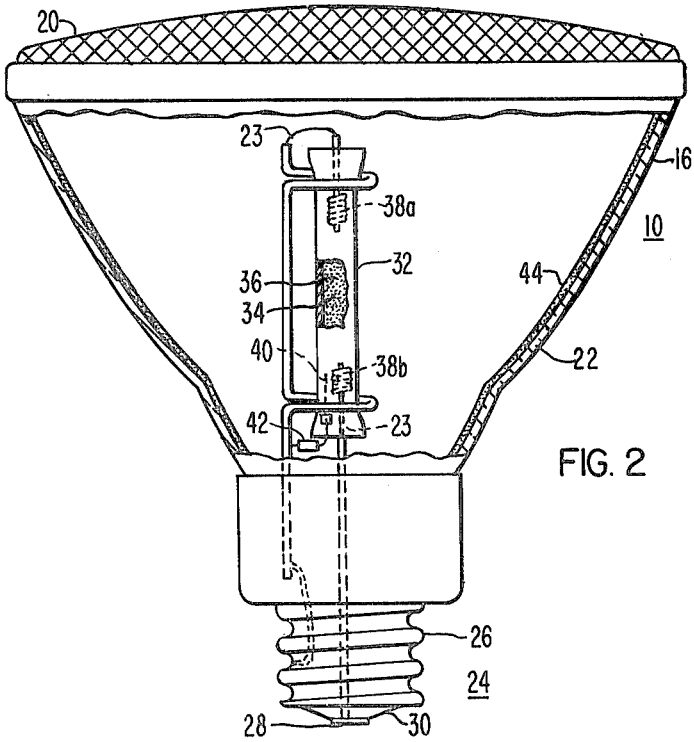
FIG. 2 is an elevational view, partly in section, of an HID mercury-metal halide lamp unit showing the location of the dichroic coating within the lamp unit.

In an alternative embodiment as shown in FIG. 2, in which like reference characters represent like parts, an HID reflector-type lamp unit 10 is provided with an elongated arc tube 32 formed of quartz enclosing a discharge sustaining filling comprising mercury 34 and selected metal halides 36. Electrodes **38*a*, 38*b* formed of tungsten are operatively disposed within the arc tube 32 proximate the ends thereof. Electrical lead-in members 23 are sealed through the arc tube 32 and are connected to the electrodes 38*a*, 38*b*. Starting electrode 40 and starting resistor 42 are connected in circuit with electrode 38*a* to aid in starting of the lamp unit 10. The remaining structure of the lamp unit 10** as shown in FIG. 2 is identical to the foregoing embodiment.

The general construction of HID sodium lamps is well known and as an example, reference is made to U.S. Pat. No. 3,623,134 dated Nov. 23, 1971 to Werner. Also see U.S. Pat. No. 3,882,344 dated May 6, 1975 to Knochel et al. The general construction of HID mercury-metal halide lamps is also well known and reference is made to U.S. Pat. No. 3,798,487 dated Mar. 19, 1974 to Zollweg for further details of a suitable arc tube construction.

The generally parabolic rear reflector member 22 has carried as a coating on the inner surface thereof a dichroic reflector means 44. The dichroic reflector 44 selectively reflects visible light having a wavelength from about 400 to 750 nm and selectively transmits infrared radiation having a wavelength from about 750 to 1600 nm. The dichroic reflector 30 in this embodiment is of the type manufactured by Bausch and Lomb under the trade designation Heat Control Filter 90–8.

The present invention has been found to be particularly well suited for use in a lighting unit for coal mines such as in a headlamp lighting unit on a continuous mining machine where any exposed surface of the lighting unit is required by Federal regulation to remain below a preset maximum operating temperature, in this case 150° C., for the reason that higher temperatures could constitute a safety hazard. The problem with using an aluminized reflective coating in this type of application, aside from the difficulty with voltage rise because of the reflected infrared radiation striking the arc tube, is that the reflected infrared radiation would cause the headlamp lens to exceed the foregoing preset maximum operating temperature. By using the present lamp unit 10 utilizing the dichroic reflector coating, which reflects approximately 92% of incident visible energy and transmits about 85% of the incident infrared energy, the headlamp in a 70 watt size operates well within the maximum operating temperature. In addition, by using an HID sodium vapor lamp unit, inherent benefits are realized over an incandescent lamp system in that life is increased about 10 times and light output increases by more than a factor of three.

In testing the lamp utilizing the dichroic reflector 44, as compared to an otherwise similar lamp with an aluminum reflector, in a 70 watt sodium vapor lamp unit 10, it was found that after 100 hours, the dichroic-reflector lamp produced about 17% more light output than the otherwise similar lamp with the aluminum reflector. Apparently, a dichroic reflector, such as described, is particularly efficient with respect to reflecting the visible radiations produced by a HID sodium lamp, as compared to the conventionally vapor-deposited aluminum reflector.

Whatever the explanation, the resulting improved lamp performance broadens the applications for reflector-type HID sodium lamps by improving the total light output for the directed visible radiations as compared to the light output which is normally obtained from the more conventional similar lamps which utilize an aluminized reflector.

I claim:

1. A reflector-type high-intensity-discharge sodium vapor lamp unit, said lamp unit comprising an elongated arc tube formed of alumina enclosing a discharge sustaining filling comprising sodium and having electrodes operatively disposed proximate the ends thereof, said arc tube supported within an outer protective envelope having a front cover member for permitting the passage of visible light therethrough and a generally parabolic rear reflector member, electrical lead-in members sealed through said arc tube and connected to said electrodes, electrical adaptor means affixed to said reflector member to facilitate connection of said lamp to a source of electrical power, said reflector member having a dichroic reflector means carried as a coating on the inner surface thereof, said dichroic reflector means selectively reflecting visible light having a wavelength from about 400 to 750 nm and selectively transmitting infrared radiation having a wavelength from about 750 to 1600 nm.

2. The lamp of claim 1, wherein said arc tube is axially disposed with respect to said parabolic reflector member.

3. The reflector-type high-intensity-discharge sodium vapor lamp unit as specified in claim 2, wherein said lamp unit is especially adapted for use in a lighting unit for coal mines where any exposed surface of said lighting unit is required to remain below a preset maximum operating temperature.

* * * * *